US011747006B2

(12) United States Patent
Wang

(10) Patent No.: US 11,747,006 B2
(45) Date of Patent: Sep. 5, 2023

(54) PLUG-IN LAMP

(71) Applicant: Jianguo Wang, Dongguan (CN)

(72) Inventor: Jianguo Wang, Dongguan (CN)

( * ) Notice: Subject to any disclaimer, the term of this patent is extended or adjusted under 35 U.S.C. 154(b) by 0 days.

(21) Appl. No.: 17/881,633

(22) Filed: Aug. 5, 2022

(65) Prior Publication Data

US 2022/0373169 A1 Nov. 24, 2022

(51) Int. Cl.

| | |
|---|---|
| ***F21V 23/06*** | (2006.01) |
| ***F21V 21/002*** | (2006.01) |
| *F21Y 115/10* | (2016.01) |

(52) U.S. Cl.
CPC ..... *F21V 23/06* (2013.01); *F21V 21/002* (2013.01); *F21Y 2115/10* (2016.08)

(58) Field of Classification Search
CPC ..... F21V 23/06; F21V 21/002
See application file for complete search history.

(56) References Cited

U.S. PATENT DOCUMENTS

| | | | | |
|---|---|---|---|---|
| 6,074,073 | A * | 6/2000 | Huang | F21V 21/0824 362/653 |
| 6,079,848 | A * | 6/2000 | Ahroni | H01R 4/242 439/699.1 |
| 6,305,828 | B1 * | 10/2001 | Huang | H01R 33/22 362/396 |
| 6,328,593 | B1 * | 12/2001 | Chang | H01R 33/965 439/419 |
| 10,718,504 | B1 * | 7/2020 | Liang | H01R 33/09 |
| 10,900,656 | B1 * | 1/2021 | Wang | F21S 4/10 |
| 2014/0355277 | A1 * | 12/2014 | Lin | H01R 33/09 362/391 |
| 2017/0159922 | A1 * | 6/2017 | Chen | F21V 23/06 |

* cited by examiner

*Primary Examiner* — Christopher E Dunay

(57) ABSTRACT

The present disclosure relates to the field of lamps, and in particular to a plug-in lamp. The plug-in lamp includes a lamp base and a light source assembly. The lamp base includes a lamp base housing and a lamp base cover. The lamp base cover is capped on the top of the lamp base housing, connecting wires between the lamp base housing and the lamp base cover are contacted with ends of connecting terminals to realize electrical connection, and plug-in male terminals are respectively plugged into two plug-in holes to realize electrical connection. According to the present disclosure, the structural design is simple and reasonable, and the production efficiency is greatly improved.

8 Claims, 9 Drawing Sheets

PLUG-IN LAMP

TECHNICAL HELD

The present disclosure relates to the field of lamps, in particular to a plug-in lamp.

BACKGROUND

Bulbs are a source of lighting that emits light and heat with electrical energy, and are invented by Henry Goebbels (Edison actually found right materials, that is, highly practical incandescent lamps were invented, while bulbs appeared as early as 1854). The most common function of bulbs is lighting. With the development of society, the use of bulbs has also undergone different changes. At first, the bulbs may be used to provide convenience for production and life. However, with the progress of society, there have also been obvious changes in the use of bulbs, and functional lamps of different purposes such as "automobiles, landscaping and decoration" have begun to appear.

During the production of existing bulbs, wires need to be connected to a lamp base by welding, and a light-emitting assembly is electrically connected to the lamp base spirally. Such a production process takes a long time and is low in production efficiency. In addition, the process of disassembly, assembly and replacement is also laborious since solder joints are difficult to disassemble during disassembly and assembly. Such a production process not only reduces the production efficiency of bulbs, but also is not conducive to the disassembly, assembly and maintenance of bulbs during later use.

SUMMARY

In order to solve the above-mentioned problems, the present disclosure provides a plug-in lamp. The plug-in lamp of the present disclosure is simple and reasonable in structural design. Wires are quickly fixed on the top of a lamp base housing by using a lamp base cover, and electric energy of connecting wires is directly transmitted to a light-emitting LED assembly by means of connecting terminals, which greatly improves the production efficiency, and disassembly and assembly are facilitated at the same time, making it more convenient for people to use, replace and repair later.

In order to achieve the above-mentioned objects, the technical solution adopted in the present disclosure is a plug-in lamp. The plug-in lamp includes a lamp base and a light source assembly. The lamp base includes a lamp base housing and a lamp base cover, where two connecting terminals are arranged in the lamp base housing, a top end of each connecting terminal extends to an upper end of the lamp base housing, the lamp base cover is capped on the top of the lamp base housing, and connecting wires between the lamp base housing and the lamp base cover are contacted with ends of the connecting terminals to realize electrical connection. The light source assembly includes a lamp housing and a light-emitting LED assembly that is located inside the lamp housing. Two ends of the light-emitting LED assembly are respectively connected with plug-in male terminals, where two plug-in holes are defined in a bottom end of the lamp base housing, the bottom end of the lamp base housing is plugged into the lamp base housing, and the plug-in male terminals are respectively plugged into the two plug-in holes to realize electrical connection with the connecting terminals.

Further, the top of the lamp base housing is provided with a fitting part, and fitting holes are defined at four corners of the fitting part, respectively. Pins are arranged at four corners of the bottom of the lamp base cover, and the lamp base cover is clamped in the fitting holes by means of the pins to realize fitting with the lamp base housing.

Further, a positioning block is also protruded from the center of the surface of the fitting part, and the bottom of the lamp base cover is provided with a positioning groove adapted to the positioning block, where the positioning block is plugged into the positioning groove.

Further, front and rear end surfaces of the fitting part are symmetrically provided with two wire clamp notches respectively, where two ends of a same connecting wire are respectively clamped at two wire clamp notches on the same side at the front and rear ends, and an exposed metal part of the same connecting wire is in contact with the connecting terminals. Fastening blocks aligned with the wire clamp notches are protruded from the bottom of the lamp base cover, and the fastening blocks are clamped at the wire clamp notches and restrict the connecting wires within the wire clamp notches.

Further, an isolation block is protruded outwardly from the middle position of the front and rear end surfaces of the fitting part.

Further, two terminal slots that penetrate upper and lower ends of the lamp base housing are defined inside the lamp base housing, and the two plug-in holes are respectively communicated with the terminal slots. The surface of the fitting part is provided with two fitting slots in communication with the terminal slots, and the connecting terminals pass through the fitting slots and the terminal slots in turn to realize fitting with the lamp base housing.

Further, each connecting terminal includes a wire connecting part, a connecting piece and a tubular connecting part which are connected in sequence from top to bottom. The wire connecting portion is of an "M"-shaped structure, both sides of the fitting slots are provided with support protrusions with a shape adapted to that of the wire connecting part, and the support protrusions on both sides are supported on both sides of the bottom of the wire connecting part.

Further, the bottom of the lamp base cover is provided with pressing blocks facing the fitting slots, ends of the pressing blocks are of a convex curved structure, the pressing blocks are fitted in the fitting slots, and the convex curved structure compresses exposed metal parts of the connecting wires closely against the surface of the wire connecting part.

Further, the plug-in holes include first hole sites and second hole sites, which are communicated from top to bottom. The first hole sites are communicated with the terminal slots. The first hole sites are cylindrical holes and the second hole sites are tapered holes. The second hole sites have an aperture decreasing from a direction close to the first hole sites, and a minimum aperture of the second hole sites is consistent with the aperture of the first hole sites.

Further, the lamp housing includes a filament lampshade and a fitting hood that is located at an upper end of the filament lampshade. The light-emitting LED assembly is arranged inside the filament lampshade, and clamp holes are defined on both sides of the fitting hood. Bumps are arranged on both sides of the bottom of the lamp base housing, and the bumps are clamped in corresponding clamp holes.

Further, the light-emitting LED assembly includes a first current limit resistor R1, a second current limit resistor R2, a first rectifier diode D1, a second rectifier diode D2, a third rectifier diode D3, a fourth rectifier diode D4, a fifth light-emitting diode D5, a sixth light-emitting diode D6 and a seventh light-emitting diode D7. The first rectifier diode D1, the second rectifier diode D2, the third rectifier diode D3 and the fourth rectifier diode D4 constitute a rectifier bridge, and the rectifier bridge is provided with a direct-current positive output terminal, a direct-current negative output terminal, a power input terminal L and a power input terminal N. One of the plug-in male terminals is connected to the power input terminal L by means of the first current limit resistor R1, and the other plug-in male terminal is connected to the power input terminal N by means of the second current limit resistor R2, The direct-current positive output terminal is connected to a positive electrode of the fifth light-emitting diode D5, a negative electrode of the fifth light-emitting diode D5 is connected to a positive electrode of the sixth light-emitting diode D6, a negative electrode of the sixth light-emitting diode D6 is connected to a positive electrode of the seventh light-emitting diode D7, and a negative electrode of the seventh light-emitting diode D7 is connected to the direct-current negative output terminal.

The present disclosure has the following beneficial effects. In the present application, connecting wires are processed first (part of an insulating layer is peeled off to expose conducive metal parts), and the exposed metal parts of the connecting wires are placed above connecting terminals, where a lamp base cover is capped on the top of a lamp base housing, the connecting wires between the lamp base housing and the lamp base cover are contacted with ends of the connecting terminals to realize electrical connection, and a light-emitting LED assembly is plugged into plug-in holes by means of plug-in male terminals at both ends to realize electrical connection with the connecting terminals. The plug-in lamp of the present disclosure is simple and reasonable in structural design. Wires are quickly fixed on the top of the lamp base housing by using the lamp base cover, and electric energy of the connecting wires is directly transmitted to the light-emitting LED assembly by means of the connecting terminals, which greatly improves the production efficiency, and disassembly and assembly are facilitated at the same time, making it more convenient for people to use, replace and repair later.

Figure 1:
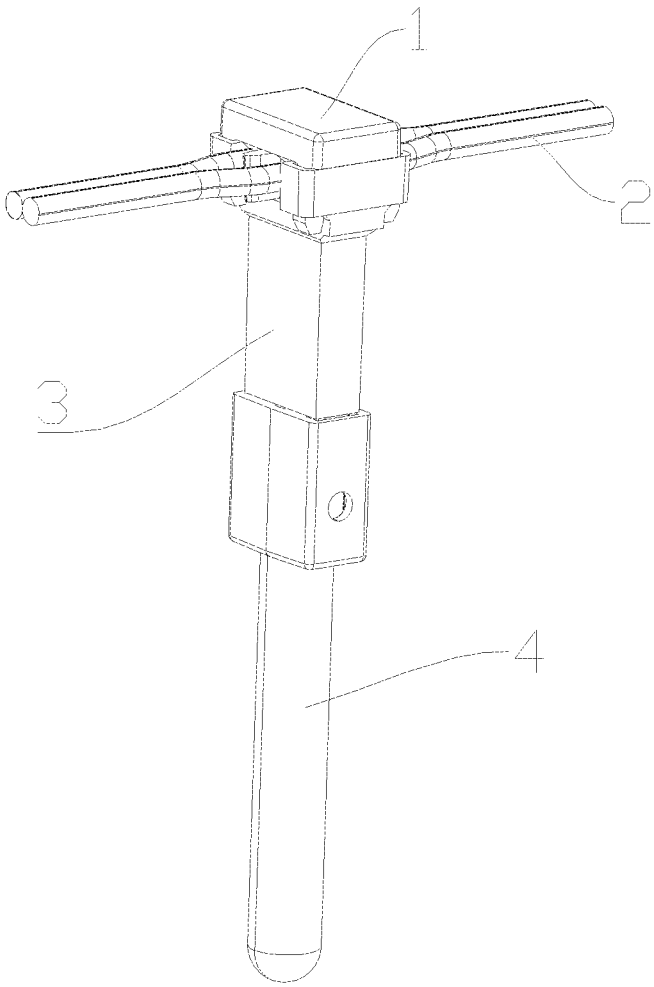
FIG. 1 is a schematic structural perspective view of a plug-in lamp.

Reference numerals: 1, Lamp Base Cover; 11, Pin; 12, Fastening Block; 13, Pressing Block; 131, Convex Curved Structure; 14, Positioning Groove; 2, Connecting Wire; 21, Metal Part; 3, Lamp Base Housing; 30, Fitting Part; 31, Fitting Hole; 32, Wire Clamp Notch; 33, Isolation Block; 34, Fitting Slot; 341, Support Protrusion; 35, Positioning Block; 36, Bump; 37, First Hole Site; 38, Second Hole Site; 39, Terminal Slot; 4, Lamp Housing; 41, Clamp Hole; 5, Connecting Terminal; 51, Wire Connecting Part; 52, Connecting Piece; 53, Tubular Connecting Part; and 61, Plug-in Male Terminal.

DETAILED DESCRIPTION

Referring to FIG. 1 to FIG. 9, the present disclosure relates to a plug-in lamp. The plug-in lamp includes a lamp base and a light source assembly. The lamp base includes a lamp base housing 3 and a lamp base cover 1. Two connecting terminals 5 are arranged in the lamp base housing 3, and a top end of each connecting terminal 5 extends to an upper end of the lamp base housing 3. The lamp base cover 1 is capped on the top of the lamp base housing 3, and connecting wires 2 between the lamp base housing 3 and the lamp base cover 1 are contacted with ends of the connecting terminals 5 to realize electrical connection. The light source assembly includes a lamp housing 4 and a light-emitting LED assembly located inside the lamp housing 4. Two ends of the light-emitting assembly are respectively connected with plug-in male terminals 61. Two plug-in holes are defined in a bottom end of the lamp base housing 3, the bottom end of the lamp base housing 3 is plugged into the lamp base housing 3, and the plug-in male terminals 61 are respectively plugged into the two plug-in holes to realize electrical connection with the connecting terminals 5.

Figure 2:
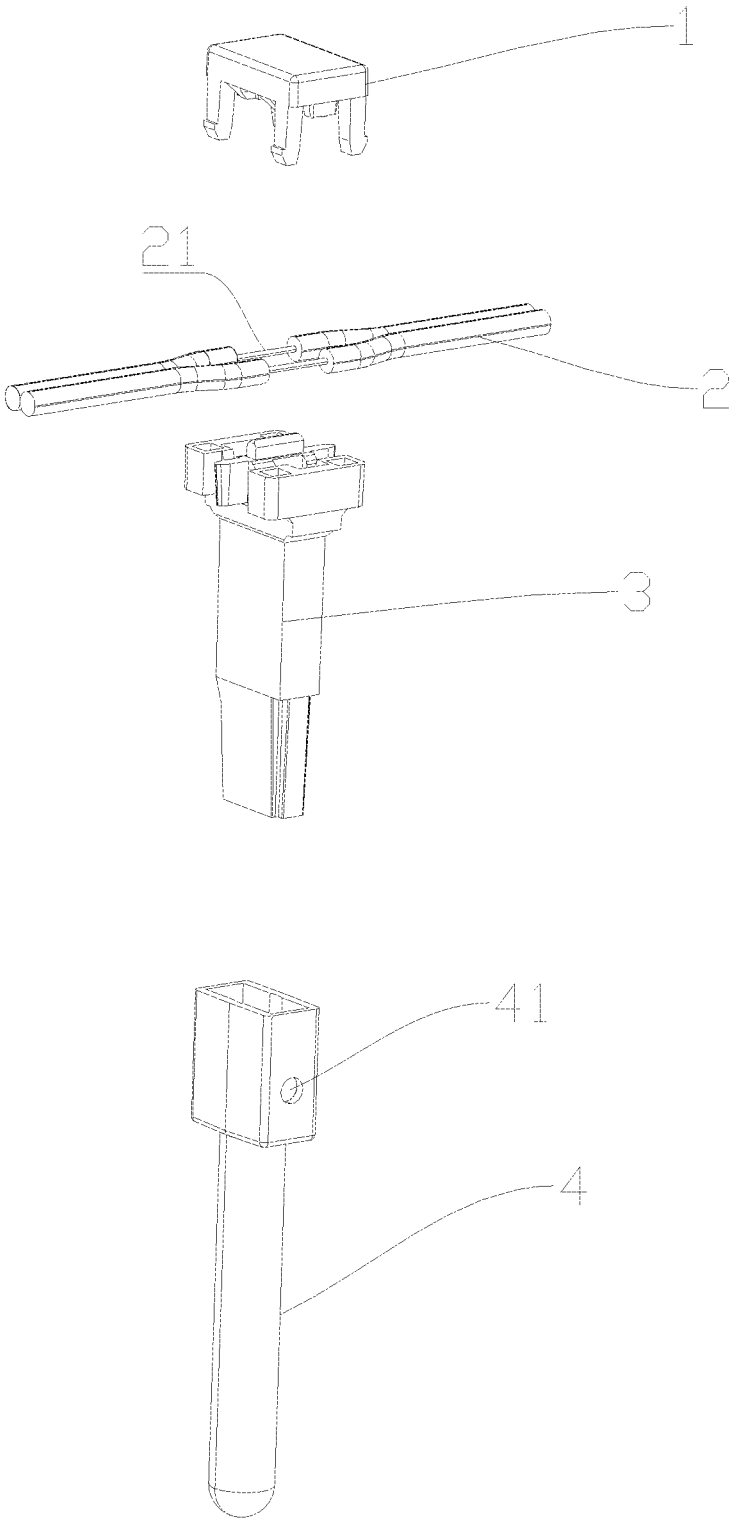
FIG. 2 is a schematic exploded structural view of the plug-in lamp with a light-emitting LED assembly omitted.

Referring to FIG. 1 and FIG. 2, in the present application, the connecting wires 2 are processed first (part of an insulating layer is peeled off to expose conductive metal parts 21), and the exposed metal parts 21 of the connecting wires 2 are placed above the connecting terminals 5. The lamp base cover 1 is capped on the top of the lamp base housing 3, and the connecting wires 2 between the lamp base housing 3 and the lamp base cover 1 are contacted with ends of the connecting terminals 5 to realize electrical connection. The light-emitting LED assembly is plugged into plug-in holes by means of plug-in male terminals 61 at both ends to realize electrical connection with the connecting terminals 5. The plug-in lamp of the present disclosure is simple and reasonable in structural design. Wires are quickly fixed on the top of the lamp base housing 3 by using the lamp base cover 1, and electric energy of the connecting wires 2 is directly transmitted to the light-emitting LED assembly, by means of the connecting terminals 5, which greatly improves the production efficiency, and disassembly and assembly are facilitated at the same time, making it more convenient for people to use, replace and repair later.

Figure 3:
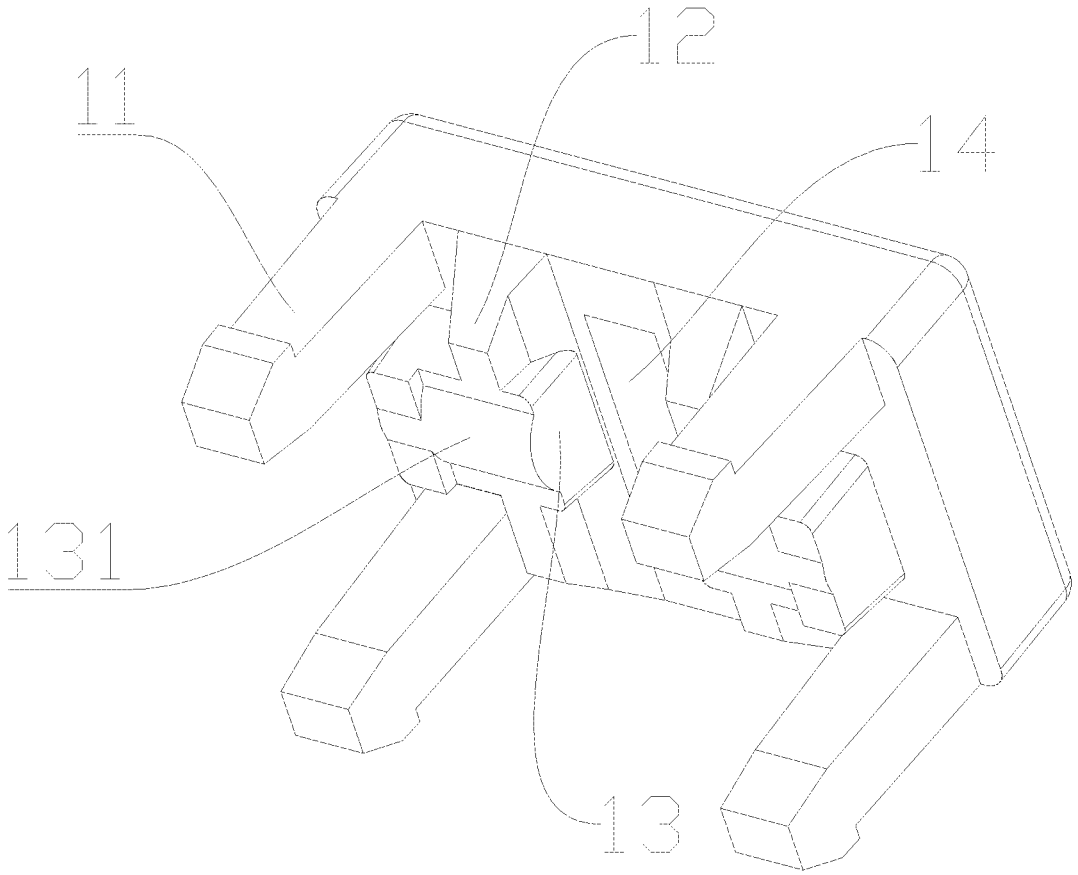
FIG. 3 is a schematic structural perspective view of a lamp base cover.
Figure 5:
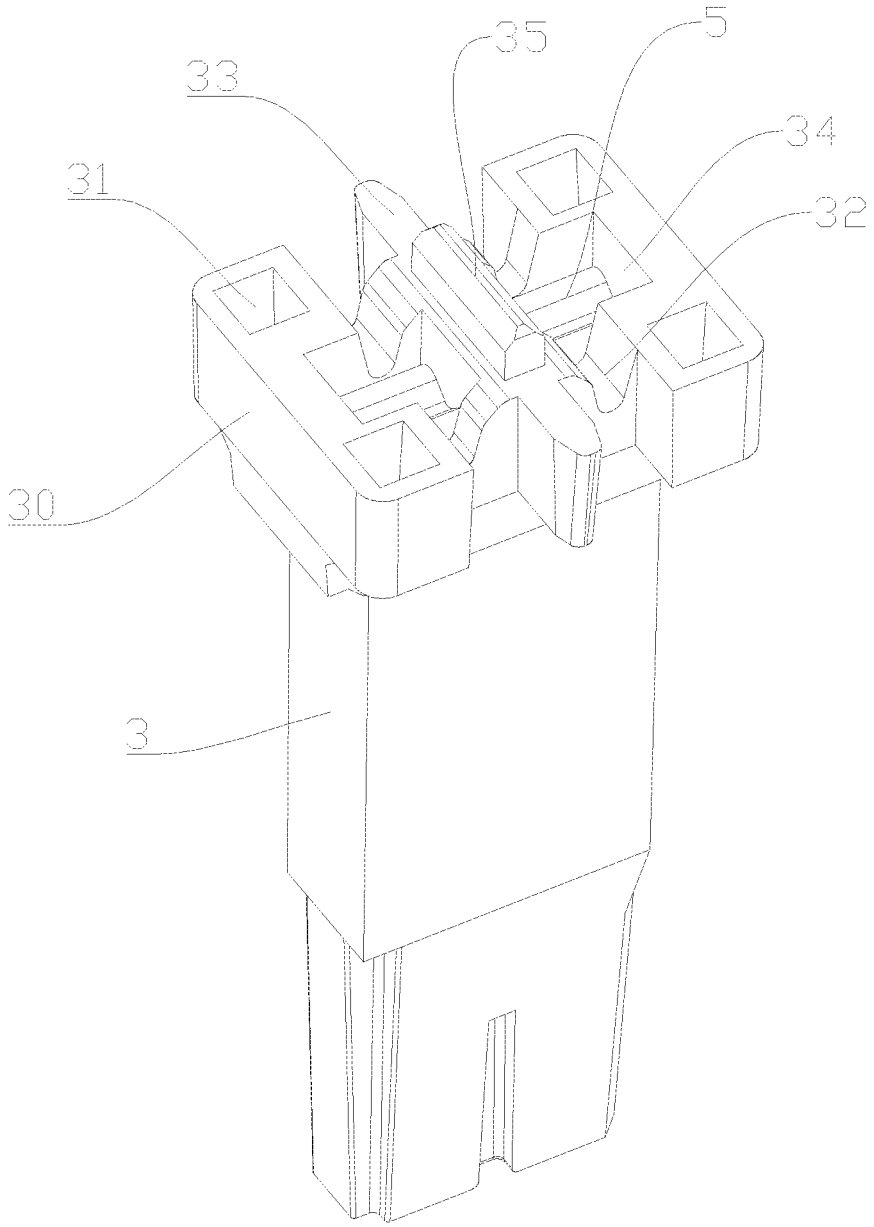
FIG. 5 is a schematic structural diagram after a lamp base housing and connecting terminals are fitted.
Figure 7:
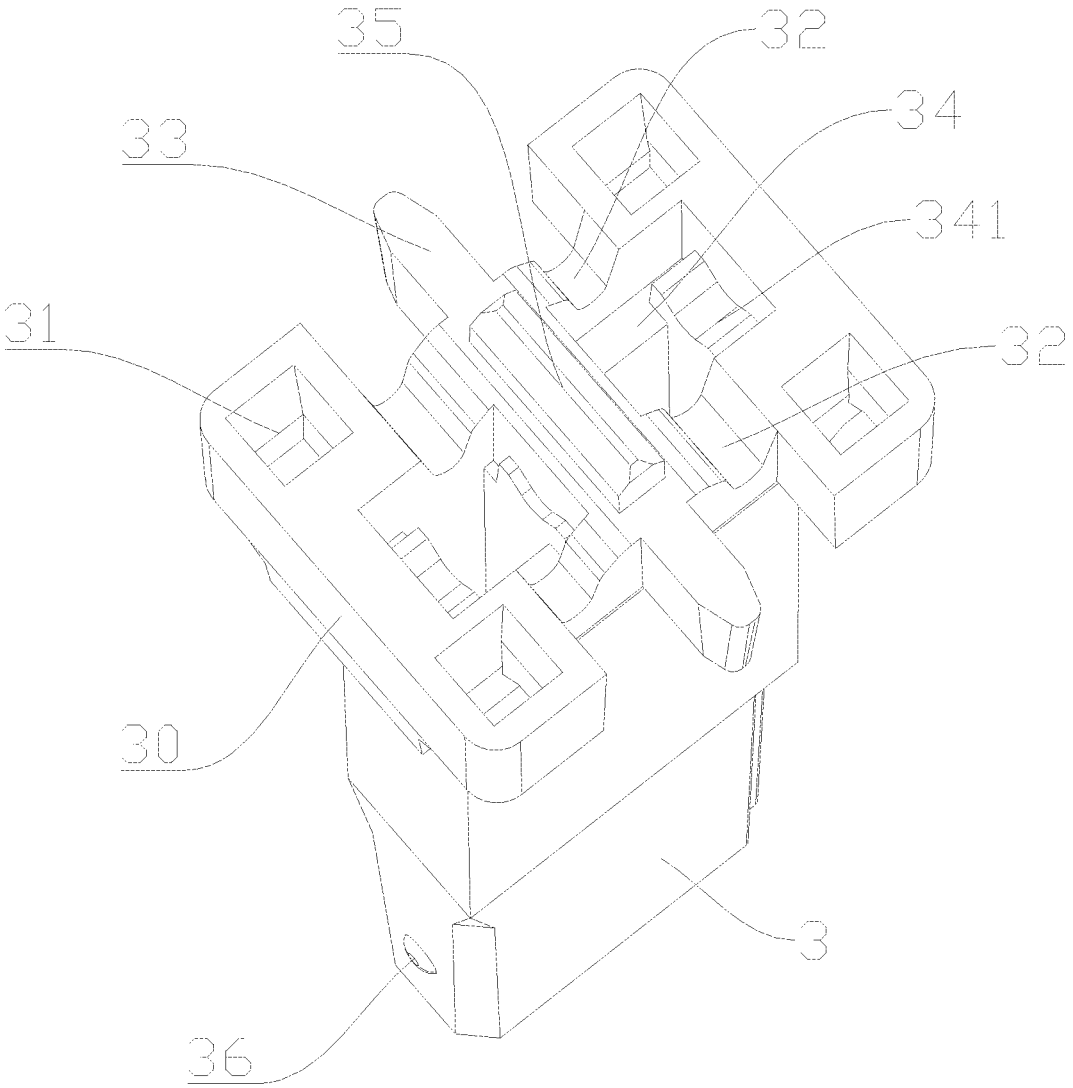
FIG. 7 is a schematic structural diagram of the lamp base housing.

Referring to FIG. 3, FIG. 5 and FIG. 7, further, the top of the lamp base housing 3 is provided with a fitting part 30, and fitting holes 31 are defined at four corners of the fitting part 30, respectively. Pins 11 are arranged at four corners of the bottom of the lamp base cover 1, and the lamp base cover 1 is clamped in the fitting holes 31 by means of the pins 11 to realize the fitting with the lamp base housing 3.

In order to further stabilize the connection between the lamp base housing 3 and the lamp base cover 1, in the present specific embodiment, fitting is carried out using pins 11 and the fitting holes 31. Ends of the pins 11 are of a barb structure, which may adhere to the bottom of the fitting part 30, so as to play a role in preventing falling off. If it is necessary to separate the stable lamp base housing 3 from the lamp base cover 1, it is only necessary to push the pins 11 towards an orifice of the fitting holes 31 to allow the barb structure to return to the orifice of the fitting holes 31, and then pull out the pins 11.

Referring to FIG. 3, FIG. 5 and FIG. 7, in order to further ensure the fitting position of the lamp base cover 1, a positioning block 35 is also protruded from the center of the surface of the fitting part 30. The bottom of the lamp base cover 1 is provided with a positioning groove 14 adapted to the positioning block 35. The positioning block 35 is plugged into the positioning groove 14, so that an impact force from a horizontal direction can be resisted to a certain extent, and the positioning block 35 functions to facilitate the positioning of the lamp base cover 1.

Figure 4:
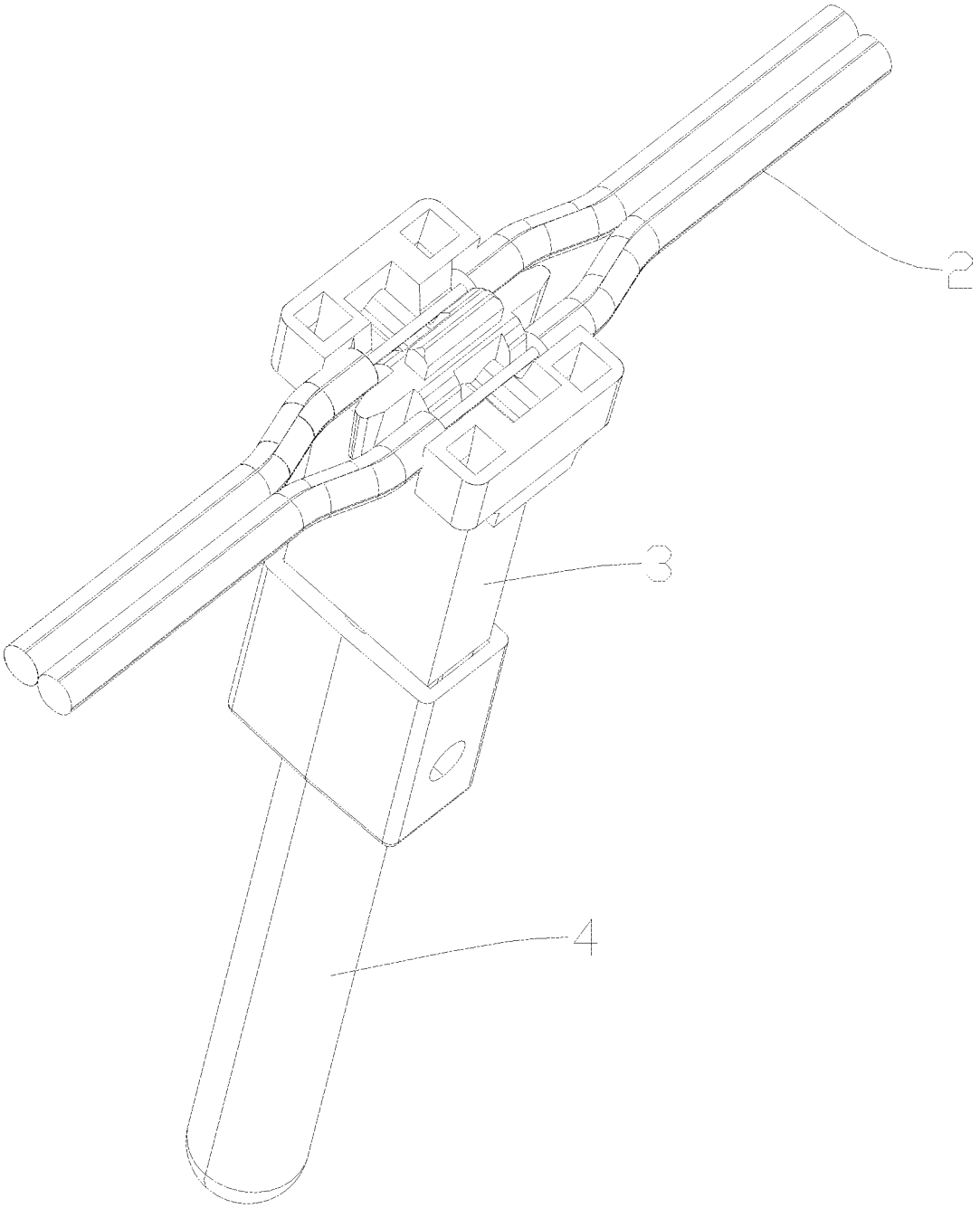
FIG. 4 is a schematic structural diagram of the plug-in lamp with the lamp base cover omitted.

Referring to FIG. 3 to FIG. 5, further, the front and rear end surfaces of the fitting part 30 are symmetrically provided with two wire clamp notches 32. Two ends of a same connecting wire 2 are respectively clamped at two wire clamp notches 32 on the same side at the front and rear ends, and an exposed metal part 21 of the same connecting wire 2 is in contact with the connecting terminals 5. Fastening blocks 12 aligned with the wire clamp notches 32 are protruded from the bottom of the lamp base cover 1. The fastening blocks 12 are clamped at the wire clamp notches 32 and restrict the connecting wires 2 within the wire clamp notches 32.

Referring to FIG. 4, in this embodiment, the exposed metal parts 21 of the connecting wires 2 may be clamped at the corresponding wire clamp notches 32 to achieve preliminary positioning, and then clamped at the wire clam notches 32 by means of the fastening blocks 12 and restrict the connecting wires 2 within the wire clamp notches 32, so that the connecting wires 2 can be prevented from falling off.

Referring to FIG. 7, further, an isolation block 30 is protruded outwardly from a middle position of the front and rear end surfaces of the fitting part 30. The isolation block 33 can isolate the two connecting wires 2 to avoid short circuit and reduce signal interference.

Figure 6:
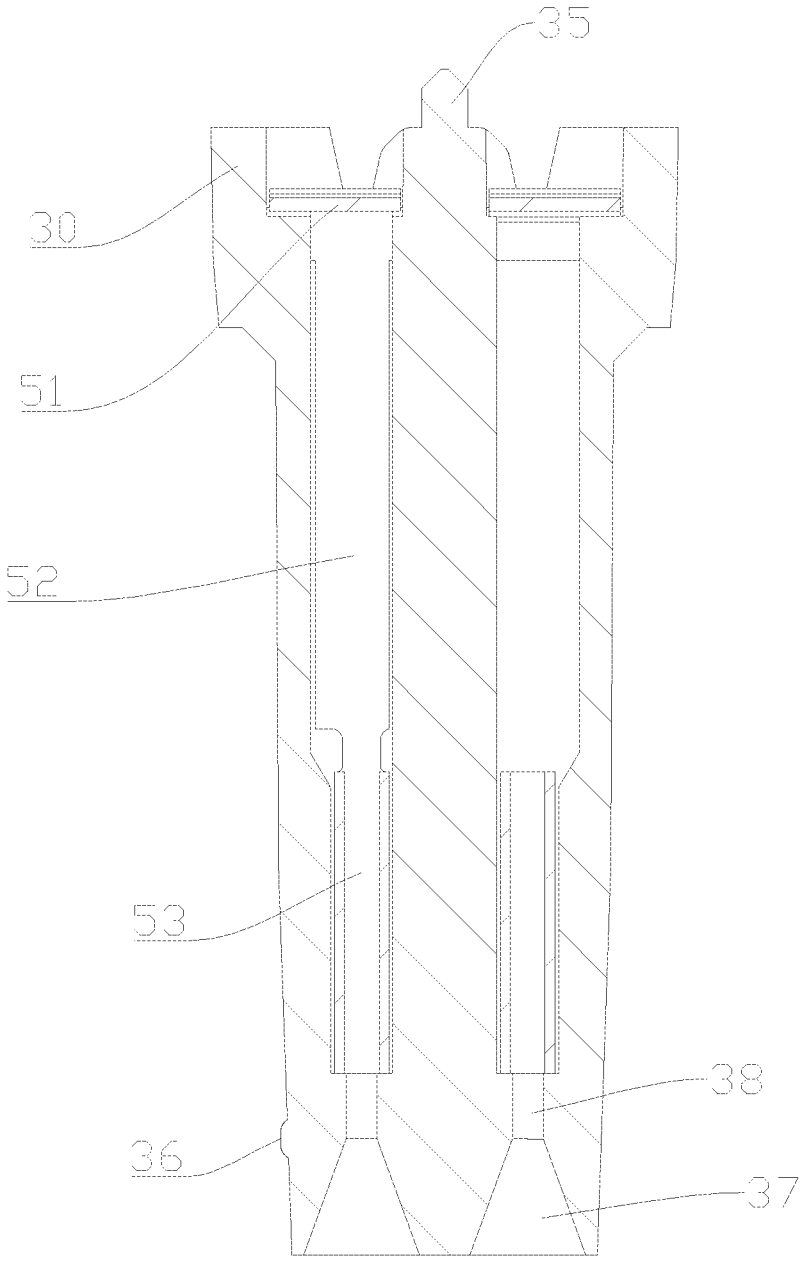
FIG. 6 is a schematic cross-sectional structural diagram on the basis of FIG. 5.
Figure 8:
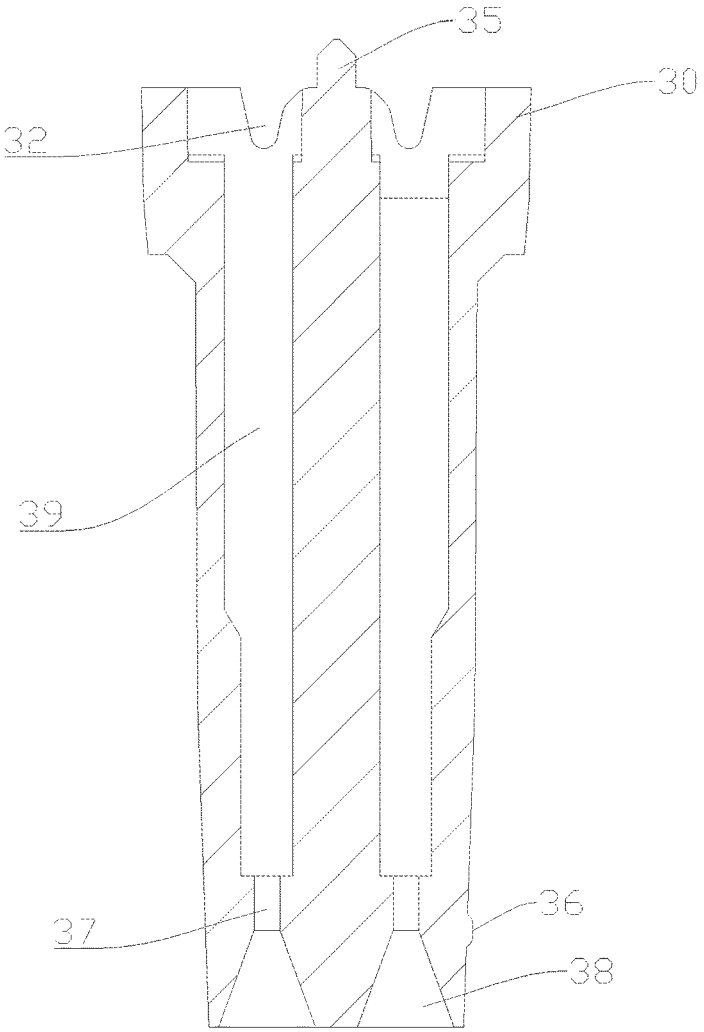
FIG. 8 is a schematic cross-sectional structural diagram on the basis of FIG. 7.

Referring to FIG. 6 to FIG. 8, further, two terminal slots 39 that penetrate upper and lower ends of the lamp base housing 3 are defined inside the lamp base housing 3, and the two plug-in holes are respectively communicated with the terminal slots 39. The surface of the fitting part 30 is provided with two fitting slots 34 in communication with the terminal slots 39, and the connecting terminals 5 pass through the fitting slots 34 and the terminal slots 39 in turn to realize the fitting with the lamp base housing 3. Each connecting terminal 5 includes a wire connecting part 51, a connecting piece 52 and a tubular connecting part 53 which are connected in sequence from top to bottom. The wire connecting portion 51 is of an "M"-shaped structure. Toth sides of the fitting slots 34 are provided with support protrusions 341 with a shape adapted to that of the wire connecting part 51, and the support protrusions 341 on both sides are supported on both sides of the bottom of the wire connecting part 51. The bottom of the lamp base cover 1 is provided with pressing blocks 13 facing the fitting slots 34, and ends of the pressing blocks 13 are of a convex curved structure 131. The pressing blocks 13 are fitted in the fitting slots 34, and the convex curved structure 131 compresses the exposed metal parts 21 of the connecting wires 2 closely against the surface of the wire connecting part 51.

In this embodiment, the support protrusions 341 on both sides are supported on both sides of the bottom of the wire connecting part 51, so that the connecting terminals 5 can be prevented from falling into the terminal slots 39, and at the same time, the wire connecting part 51 can be located in the fitting slots 34 and in contact with the connecting wires 2. In addition, in this embodiment, ends of the pressing blocks 13 are of a convex curved structure 131, the pressing blocks 13 are fitted in the fitting slots 34, and the convex curved structure 131 compresses the exposed metal parts 21 of the connecting wires 2 closely against the surface of the wire connecting part 51 (the exposed metal parts 21 becomes an M-shaped structure under the extrusion of the convex curved structure 131), so that the contact area between the exposed metal parts 21 of the connecting wires 2 and the wire connecting part can be increased to ensure power transmission.

Referring to FIG. 6 to FIG. 8, further, the plug-in holes include first hole sites 37 and second hole sites 38 which are communicated from top to bottom. The first hole sites 37 are communicated with the terminal slots 39. The first hole sites 37 are cylindrical holes and the second hole sites 38 are tapered holes. The second hole sites 38 have an aperture decreasing from a direction close to the first hole sites 37, and a minimum aperture of the second hole sites 38 is consistent with the aperture of the first hole sites 37. In this embodiment, by means of the plug-in male terminals 61, the light-emitting LED assembly first passes through the second hole sites 38, then passes through the first hole sites 37, and contacts with the tubular connecting part 53 within the fitting groove 34 to realize electrical connection. Since the second hole sites 38 are tapered holes, and the second hole sites 38 have an aperture decreasing from a direction close to the first hole sites 37, it is very easy to plug the plug-in male terminals 61 into the openings of the second hole sites 38 at the beginning. As the plug-in male terminals 61 move upward, under the action of inclined surfaces of the tapered holes, the plug-in male terminals 61 will be guided to correct positions (the first hole sites 37) to ensure contact with the tubular connecting part 53 within the fitting slots 34 to realize electrical connection.

Figure 9:
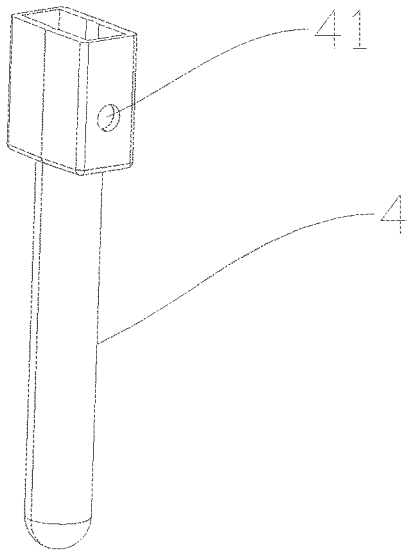
FIG. 9 is a schematic structural diagram of a lamp housing.

Referring to FIG. 9, further, the lamp housing 4 includes a filament lampshade and a fitting hood located at an upper end of the filament lampshade. The light-emitting LED assembly is arranged inside the filament lampshade, and clamp holes 41 are defined on both sides of the fitting hood. Bumps 36 are arranged on both sides of the bottom of the lamp base housing 3, and are clamped in corresponding clamp holes 41. Further, in order to facilitate the fitting between the lamp base housing 3 and the lamp housing 4, and at the same time to avoid the situation that the lamp housing 4 is offset due to special circumstances and thus causes damage to the light-emitting LED assembly. The fitting hood has a cross-sectional shape adapted to that of the bottom of the lamp base housing 3, which are both rectangular. The rectangular shape can avoid rotation of the fitting hood. In addition, the clamp holes 41 cooperate with the bumps 36 to avoid falling off of the lamp housing 4 from the bottom of the lamp base housing 3.

Figure 10:
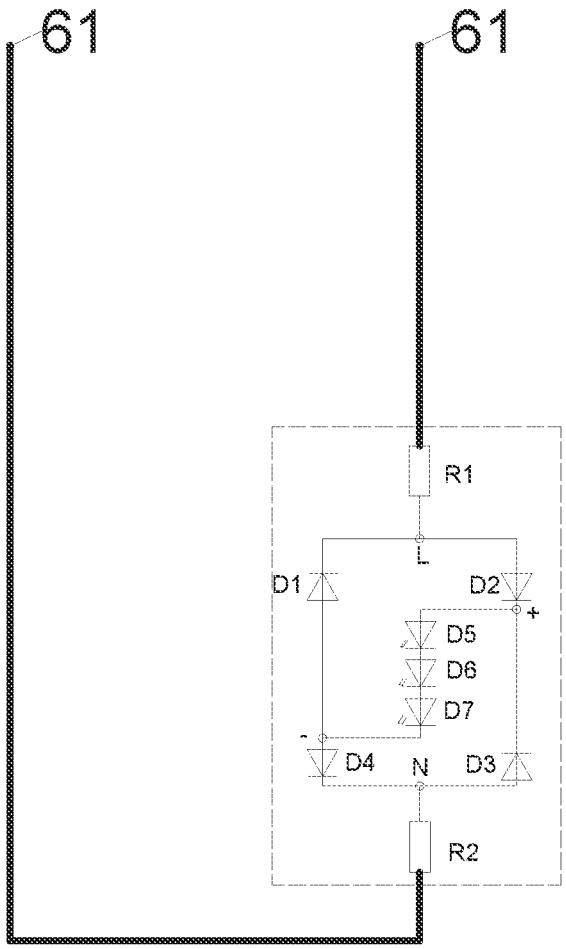
FIG. 10 is a schematic circuit diagram of the light-emitting LED assembly.

Meanwhile, in the present application, the light-emitting LED assembly includes a first current limit resistor R1, a second current limit resistor R2, a first rectifier diode D1, a second rectifier diode D2, a third rectifier diode D3, a fourth rectifier diode D4, a fifth light-emitting diode D5, a sixth light-emitting diode D6 and a seventh light-emitting diode D7. The first rectifier diode D1, the second rectifier diode D2, the third rectifier diode D3 and the fourth rectifier diode D4 constitute a rectifier bridge. The rectifier bridge is provided with a direct-current positive output terminal, a direct-current negative output terminal, a power input terminal L and a power input terminal N. One of the plug-in male terminals 61 is connected to the power input terminal L by means of the first current limit resistor R1, and the other plug-in male terminal 61 is connected to the power input terminal N by means of the second current limit resistor R2. The direct-current positive output terminal is connected to a positive electrode of the fifth light-emitting diode D5, a negative electrode of the fifth light-emitting diode D5 is connected to a positive electrode of the sixth light-emitting diode D6, a negative electrode of the sixth light-emitting diode D6 is connected to a positive electrode of the seventh light-emitting diode D7, and a negative electrode of the seventh light-emitting diode D7 is connected to the direct-current negative output terminal. The first rectifier diode D1, the second rectifier diode D2, the third rectifier diode D3 and the fourth rectifier diode D4 constitute a rectifier bridge and convert, alternating current to direct current. At the same time, the plug-in male terminal 61 at one end is connected to the rectifier bridge by means of the current limit resistor R1, the other end of the rectifier bridge is connected to the other plug-in male terminal 61 by means of the current limit resistor R2, and the light-emitting diode D5, the light-emitting diode D6 and the light-emitting diode D7 are connected in series and arranged inside the rectifier bridge. Specific circuit connection structures may refer to FIG. 10.

The above-mentioned embodiments are only to describe the preferred embodiments of the present disclosure, and are not intended to limit the scope of the present disclosure. Various modifications and improvements made to the technical solutions of the present disclosure by those having ordinary skill in the art without departing from the design spirit of the present disclosure should fall within the scope of protection defined by the claims of the present disclosure.

The invention claimed is:

1. A plug-in lamp, comprising a lamp base and a light source assembly, wherein the lamp base comprises a lamp base housing and a lamp base cover, two connecting terminals are arranged in the lamp base housing, a top end of each connecting terminal extends to an upper end of the lamp base housing, the lamp base cover is capped on the top of the lamp base housing, and connecting wires between the lamp base housing and the lamp base cover are contacted with ends of the connecting terminals to realize electrical connection, wherein the connecting wires have exposed metal parts;

the light source assembly comprises a lamp housing and a light-emitting LED assembly located inside the lamp housing, and two ends of the light-emitting LED assembly are respectively connected with plug-in male terminals, where two plug-in holes are defined in a bottom end of the lamp base housing, the bottom end of the lamp base housing is plugged into the lamp base housing, and the plug-in male terminals are respectively plugged into the two plug-in holes to realize electrical connection with the connecting terminals;

exposed metal parts of the connecting wires are placed above the connecting terminals;

the top of the lamp base housing is provided with a fitting part, the front and rear end surfaces of the fitting part are symmetrically provided with two wire clamp notches respectively, and an isolation block is protruded outwardly from the middle position of the front and rear end surfaces of the fitting part;

two terminal slots penetrating upper and lower ends of the lamp base housing are defined inside the lamp base housing, the two plug-in holes are respectively communicated with the two terminal slots, the surface of the fitting part is provided with two fitting slots in communication with the terminal slots, and the connecting terminals pass through the fitting slots and the terminal slots in turn to realize the fitting with the lamp base housing, wherein the fitting slots have at least two sides;

the at least two sides of the fitting slots are provided with support protrusions with a shape adapted to the shape of the wire connecting part, and the support protrusions on both sides are supported on both sides of the bottom of the wire connecting part;

the bottom of the lamp base cover is provided with pressing blocks facing the fitting slots, ends of the pressing blocks are of a convex curved structure, the pressing blocks are fitted in the fitting slots, and the convex curved structure compresses the exposed metal parts of the connecting wires closely against the surface of the wire connecting part.

2. The plug-in lamp of claim 1, wherein fitting holes are defined at four corners of the fitting part, respectively; pins are arranged at four corners of the bottom of the lamp base cover, and the lamp base cover is clamped in the fitting holes by means of the pins to realize fitting with the lamp base housing.

3. The plug-in lamp of claim 2, wherein a positioning block is also protruded from the center of the surface of the fitting part, and the bottom of the lamp base cover is provided with a positioning groove adapted to the positioning block, the positioning block is plugged into the positioning groove.

4. The plug-in lamp of claim 3, wherein two ends of a same connecting wire are respectively clamped at two wire clamp notches on the same side at the front and rear ends, an exposed metal part of the same connecting wire is in contact with the connecting terminals, and fastening blocks aligned with the wire clamp notches are protruded from the bottom of the lamp base cover, the fastening blocks are clamped at the wire clamp notches and restrict the connecting wires within the wire clamp notches.

5. The plug-in lamp of claim 4, wherein each connecting terminal comprises a wire connecting part, a connecting piece and a tubular connecting part which are connected in sequence from top to bottom, the wire connecting part is of an "M"-shaped structure.

6. The plug-in lamp of claim 1, wherein the plug-in holes comprise first hole sites and second hole sites which are communicated from top to bottom, the first hole sites are communicated with the terminal slots, the first hole sites are cylindrical holes and the second hole sites are tapered holes, the second hole sites have an aperture decreasing from a direction close to the first hole sites, and a minimum aperture of the second hole sites is consistent with the aperture of the first hole sites.

7. The plug-in lamp of claim 1, wherein the lamp housing comprises a filament lampshade and a fitting hood located at an upper end of the filament lampshade, the light-emitting LED assembly is arranged inside the filament lampshade, and clamp holes are defined on both sides of the fitting hood; bumps are arranged on both sides of the bottom of the lamp base housing, and the bumps are clamped in corresponding clamp holes.

8. The plug-in lamp of claim 1, wherein the light-emitting LED assembly comprises a first current limit resistor, a second current limit resistor, a first rectifier diode, a second rectifier diode, a third rectifier diode, a fourth rectifier diode, a fifth light-emitting diode, a sixth light-emitting diode and a seventh light-emitting diode, the first rectifier diode, the second rectifier diode, the third rectifier diode and the fourth rectifier diode constitute a rectifier bridge, and the rectifier bridge is provided with a direct-current positive output terminal, a direct-current negative output terminal, a power input terminal L and a power input terminal N; one of the plug-in male terminals is connected to the power input terminal L by means of the first current limit resistor, and the other plug-in male terminal is connected to the power input terminal N by means of the second current limit resistor; the direct-current positive output terminal is connected to a positive electrode of the fifth light-emitting diode, a negative electrode of the fifth light-emitting diode is connected to a positive electrode of the sixth light-emitting diode, a negative electrode of the sixth light-emitting diode is connected to a positive electrode of the seventh light-emitting diode, and a negative electrode of the seventh light-emitting diode is connected to the direct-current negative output terminal.

* * * * *